US005878976A

United States Patent [19]

Duck

[11] Patent Number: 5,878,976

[45] Date of Patent: Mar. 9, 1999

[54] SPRING ACTUATED, PAPER TOWEL HOLDING AND DISPENSING APPARATUS

[76] Inventor: Patrick Duck, 8732 Edmonston Rd., College Park, Md. 20740

[21] Appl. No.: 24,035

[22] Filed: Feb. 16, 1998

[51] Int. Cl.[6] ..... B65H 16/06

[52] U.S. Cl. ..... 242/596.1; 242/423.1; 242/596.6

[58] Field of Search ..... 242/596.1, 596.7, 242/596.3, 596.6, 423.1, 423.2

[56] References Cited

U.S. PATENT DOCUMENTS

| | | | |
|---|---|---|---|
| D. 347,534 | 6/1994 | Gottselig | D6/522 |
| 2,021,417 | 11/1935 | Hoffman . | |
| 2,801,809 | 8/1957 | Glaner . | |
| 3,034,738 | 5/1962 | Kuhn . | |
| 3,088,686 | 5/1963 | Curry . | |
| 3,362,653 | 1/1968 | Carlisle . | |
| 4,105,168 | 8/1978 | Rutherford . | |
| 4,239,163 | 12/1980 | Christian . | |
| 4,535,947 | 8/1985 | Hidle . | |
| 5,292,083 | 3/1994 | Ridenour . | |
| 5,374,008 | 12/1994 | Halvorson | 242/598 |

FOREIGN PATENT DOCUMENTS

| | | |
|---|---|---|
| 350786 | 1/1990 | European Pat. Off. . |
| 1301030 | 8/1969 | Germany . |

*Primary Examiner*—Donald P. Walsh
*Assistant Examiner*—William A. Rivera
*Attorney, Agent, or Firm*—John D. Gugliotta

[57] ABSTRACT

A spring actuated, paper towel holding and dispensing apparatus which functions to provide adjustable and constant pressure to paper towels by utilizing a main body which slidably engages two support arms, with lateral tension being provided by a set of spring members which runs inside the main body and connects the support arms. Such lateral force permits lateral adjustment of the device to fit a variety of paper towels of differing lateral widths. The paper towel roll is secured to the device by a tension adjustment assembly, which provides constant, even, adjustable lateral tension to the paper towel roll itself, and not the paper towels. The lateral pressure is provided by either a threaded tensioning system or a retractable spring tensioning system.

13 Claims, 7 Drawing Sheets

SPRING ACTUATED, PAPER TOWEL HOLDING AND DISPENSING APPARATUS

BACKGROUND OF THE INVENTION

1. Field of the Invention

The present invention relates generally to dispensing apparatus for rolled material, more particularly, to a spring actuated, paper towel holding and dispensing apparatus.

2. Description of the Related Art

As is well-known in the art, numerous devices exist which simplify the process of holding and dispensing of rolled materials, such as bathroom tissue and paper towels. It is also well known that when rolled materials are dispensed, certain problems are routinely encountered. These include the following.

The first problem with the previous art devices is the unintentional disconnection of the paper towel roll from the support and dispensing device. This is due to the structure of many paper towel holding and dispensing apparatus. Many designs include a pair of support arms which extend outward perpendicularly from a base support. These arms normally contain cylindrical shafts mounted horizontally to the arms, upon which the open ends of the paper towel roll are inserted. Others incorporate a spindle placed through the paper towel roll and which connects to both support arms. The paper towel roll is attached to the paper towel holder by pulling the support arms outward, away from the ends of the paper towel roll, such that the paper towel roll can be inserted over the protruding cylindrical shaft, or in the case of devices with spindles, the spindle can be connected to both cylindrical shafts. This outward movement of the support arms flexes the base support, placing significant pressure on it, and over time, deforming the base support. In fact, the pressure on the base support is intentional, as it creates a means of creating the lateral force required between the support arms and the paper towel roll to keep the paper towel roll in place. This deformation of the base support reduces the lateral force that the support arms can exert on the ends of the paper towel roll, or the spindle, thus allowing the paper towel roll to detach from the assembly, most likely during the dispensing of the paper towels.

Some rolled material holding and dispensing devices attempt to solve this deformation problem by utilizing a spring loaded spindle that connects to both support arms. Examples of this technology as applied to toilet paper dispensers, include U.S. Pat. No. 5,374,008, issued in the name of Halvorson et. al., U.S. Pat. No. 3,362,653, issued in the name of Carlisle, U.S. Pat. No. 2,801,809, issued in the name of Glaner, U.S. Design Pat. No. D347,534, issued in the name of Gottselig. Other devices, such as that disclosed in U.S. Pat. No. 5,292,083, issued in the name of Ridenour, utilize a spring, without a spindle, that slides into the paper towel roll cardboard core, to apply the lateral force upon the support arms.

There are, however, problems with applying this type of technology to paper towel holding and dispensing devices. First, these devices and others that utilize the spring loaded spindle are usually used in conjunction with metal dispensers. The base support of these devices can withstand the pressure that the spindle places on the support arms without deforming. Paper towel holders, however, are usually plastic in design, and as such, the pressure placed on the base support from the spring loaded spindle will cause the deformation of the base support and subsequent detachment of the paper towel roll, as discussed above in relation to typical rolled paper dispensers. Thus, plastic paper towel holders with spring loaded spindles are problematic. Second, the metal assemblies, necessary for the adequate function of the spring loaded spindle, are prohibitively heavy, as many paper towel holders are mounted on counter tops without wooden wall supports to be connected to. As such, the metal devices would detach from the drywall, and cause aesthetic damage to the wall. Furthermore, the use of metal in the fabrication of paper towel holders creates several other problems, including increased cost, and increased difficulty of manufacture.

Another problem with spindles is that the use of spindles as a means of attaching the rolled paper to the dispensing assembly is burdensome. The spindle must be removed and reinserted into a new paper towel roll each time one runs out of paper towels, and the spindle must then be connected to the support arms with the bulky paper towel roll obstructing one's view and limited hand space to connect the spindle and the support arms. Also, the spindles typically fall out of the paper towel roll cardboard core during attachment and detachment of the paper towel roll, creating frustration for the user. Second, the spindles fall to the ground and disassemble when the support arms fail to support the paper towel roll during dispensing. Also, upon detachment, the spindle is likely to get lost, even if temporarily, thus adding to frustration of the user. Fourth, the fact that many of the springs are not secured within the spindle housing means that these components will likely spill out even when the roll is purposefully being detached, as during roll changes.

U.S. Pat. No. 4,535,947, issued in the name of Hidle, attempts to deal with the disconnection problem another way. The '947 device discloses support cylinders which are inserted into the roll of paper towels, increasing the axial penetration of the cylindrical shafts, and which connect to the support arms, thus keeping the roll from disconnecting. There are problems with this design, however. First, removing the support cylinders from a used device is time consuming and burdensome. Second, the overall design is complicated. Third, the device does not address the other problems discussed below.

Another problem associated with the dispensing of rolled paper products is the inability to control the exact amount of paper to be dispensed in an easy manner. This problem is due to the fact that most paper towel holders offer too much or too little resistance to the rolling action of the paper towel roll.

Devices which attempt to deal with this problem have generally been of the type disclosed in U.S. Pat. No. 4,239,163, issued in the name of Christian. The '163 device discloses a tissue roll holder brake member insertable to fit snugly into an open end of a cardboard tube on which a roll of tissue paper is wound. The '163 device also employs a spring loaded spindle, which creates the deformation problems when applied to plastic paper towel dispensers, discussed above. As such, the '163 device cannot be adapted to work effectively on paper towel dispensing apparatus.

Some devices rely on the flexing of the support arms and rear main support to place pressure on the paper towel roll. These devices suffer from the deformation problems discussed above. Also, the devices do not place pressure primarily against the cardboard roll that holds the paper towels, but instead, place what little pressure they do create, on the entire paper towel roll. Typically, the entire ends of the paper towel roll rest against the support arms. This configuration gives much resistance when the paper towel roll is full, and the paper towel roll is in contact with a large surface area of the support arms, but offers little resistance when the paper towel roll is near empty. Thus, it is too difficult to turn the paper towel roll when it is full, and too much paper comes off the paper towel roll when it is nearly empty.

In addition, too much pressure on the paper towel roll will likely result in a detachment of the paper towel roll from the device, as the additional force required to tear a sheet of paper towel will likely disconnect the paper towel roll from its point of attachment.

Another problem with devices in the previous art relates to their inability to accommodate paper towel rolls whose widths differ. Different brands of paper towels utilize paper towel roll cardboard cores of differing lengths, and paper towels of differing widths. Because the support arms of these devices are at a fixed distance apart from each other, they cannot adapt to these variations. Paper towel rolls of decreased width cause the roll to detach, while rolls of increased width cause the base support deformation problems discussed above.

A search of the previous art did not disclose any patents that read directly on the claims of the instant invention. Consequently, a need has been felt for providing a simple and economical paper towel holding and dispensing device which overcomes the problems associated with the previous art.

SUMMARY OF THE INVENTION

It is therefore a general object of the present invention to provide an improved, spring activated, paper towel holding and dispensing apparatus that is effective, simple and easy to use, and facilitates the controlled dispensing of paper towels.

In accordance with a preferred embodiment of the present invention, a spring actuated, paper towel holding and dispensing apparatus is disclosed, consisting of a base support, attachment holes, base support male projections, support arm receiving orifices, support arms, cylindrical shafts, spring members, spring member guides, spring member guide holes, spring member retaining orifices, spring member alignment protrusions, base support retention means, flanges, tension adjustment assemblies, retaining rings, cylindrical shaft threads, cylindrical shaft retaining ridges, cylindrical shaft receiving orifices, retaining tabs, retaining notches, retaining tab ridges, tension adjustment means, grooves, tension adjustment means threads, auxiliary spring members, auxiliary spring member retaining orifices, and auxiliary spring member retaining projections.

The base support is longitudinally elongated, and is constructed of a durable, lightweight material, such as plastic. Positioned in lateral linear alignment on the base support are two attachment holes, which can be used in conjunction with an attachment means, such as screws, to attach the present invention to a wall, underneath a cabinet, etc. The base support extends outward and terminates on either end with a base support male projection. The base support male projections are tapered in design. Each of the two base support male projections passes into and terminates inside of a support arm receiving orifice. Attached to the end of each support arm receiving orifice is a support arm. Each support arm is elongated and extends outward, perpendicular to the centerline of the base support. Connected to the interior surface of each support arm, opposite the support arm receiving orifice, is a cylindrical shaft. Each cylindrical shaft is mounted such that its center line is perpendicular to the interior planar surface of each support arm and parallel to the centerline of the base support.

Two spring members are positioned within the base support. The two spring members extend laterally, running parallel to the center line of the base support, which is hollow in design. Each spring member is positioned in the same plane relative to the centerline of the base support. Each spring member passes through the center of the base support, being kept equidistant from each other by means of a spring member guide.

The spring member guide consists of two spring guide member holes positioned in linear alignment. The spring member guide is positioned at the end of each base support male projection. Each spring member passes through the hollow base support male projection and through a spring member guide hole. Each spring member attaches to the support arm by means of a spring member retaining orifice, which is positioned on the exterior surface of a spring member alignment protrusion. The spring member alignment protrusions are cylindrical in shape, and are positioned on the interior surface of the support arm receiving orifice, extending laterally outward, toward the base support. Each spring member alignment protrusion is in linear alignment with the corresponding spring member.

When each base support male projection is inserted into the corresponding support arm receiving orifice, each of the two spring member alignment protrusions is inserted into the corresponding spring member guide hole. A base support retention means, such as a raised wedge, is positioned on the rear interior surface of the support arm receiving orifice. The base support retention means is positioned such that it increases in thickness as its depth into the support arm receiving orifice increases. Once the spring member guide slides over the base support retention means, its lateral movement is limited such that the base support male projection cannot exit from the support arm receiving orifice. Once the base support and the support arm receiving orifice are connected, the relative position of each support arm with respect to the base support can be varied such that the lateral distance between the support arms can be adjusted to fit a variety of paper towel rolls of differing widths.

Each cylindrical shaft contains a flange at the position where the paper towel roll cardboard core contacts the cylindrical shaft. The flange permits the cylindrical shafts to come in contact primarily with the paper towel roll cardboard core, and not the sheets of paper towels. This creates even tension regardless of the amount of paper towels on the paper towel roll.

In an alternate embodiment of the present invention, tension adjustment assemblies located on each support arm are used to adjust the lateral force placed upon a paper towel roll. Each cylindrical shaft is held in lateral placement by means of a retaining ring. The interior surface of the cylindrical shaft is equipped with cylindrical shaft threads. Located on the exterior surface of each cylindrical shaft are a series of three cylindrical shaft retaining ridges, which are equidistantly located relative to the radial center of the cylindrical shaft.

A cylindrical shaft receiving orifice is positioned in the center of each support arm on the side of the support arm opposite the base support. The radial center of the cylindrical shaft receiving orifice is parallel to the center line of the base support.

Positioned on the exterior surface of the support arm, along the outside edge of the cylindrical shaft receiving orifice, are a series of retaining tabs. Equally spaced between the retaining tabs are three retaining notches. The cylindrical shaft slides into the cylindrical shaft receiving orifice. The cylindrical shaft retaining ridges fit in the corresponding retaining notch on the support arm, thereby, limiting rotational movement of the cylindrical shaft.

Located on the ends of the retaining tabs is a series of retaining tab ridges. The retaining tab ridges connect to the tension adjustment means by snapping into grooves on the tension adjusting means. The tension adjusting means is equipped with threads which mate with the cylindrical shaft threads. Turning the tension adjusting means clockwise causes the cylindrical shaft to telescope into the end of the paper towel roll cardboard core, thus creating the necessary tension to control the dispensing of paper towels, while simultaneously ensuring that the paper towel roll will not detach from the cylindrical shafts.

In another alternate embodiment of the present invention, a set of auxiliary spring members is positioned so as to connect to both the lower, interior surface of each support arm and the corresponding frontal surface of the base support. The auxiliary spring members are attached to auxiliary spring member retaining orifices which are positioned on the end of a pair of auxiliary spring member retaining projections. The auxiliary spring member retaining projections are positioned so as to not interfere with the rotational movement of the paper towel roll. The auxiliary spring members, like the tension adjustment assembly of the other alternate embodiment discussed above, create the lateral force required for the controlled dispensing of the paper towels while simultaneously ensuring that the paper towel roll stays attached to the cylindrical shafts.

To use the device in any of its embodiments, one separates the support arms by pulling them apart. The paper towel roll is then placed in between the support arms, and the paper towel roll cardboard core is place over the cylindrical shafts. The separation of the two support arms elongates the two spring members, which places sufficient, even, lateral forces on the paper towel roll cardboard core when the support arms are released. The paper towel roll will turn slowly and evenly, permitting the easy tearing of the desired number of towels, with one hand, without the paper towel roll becoming disconnected from the cylindrical shafts.

In the alternate embodiment with the tension adjustment assemblies, the same process is repeated. However, once the support arms have been released, then each tension adjusting means is turned clockwise, thus forcing the cylindrical shaft deeper into the paper towel roll cardboard core.

In the alternate embodiment with the auxiliary spring members, the same process is repeated as in the preferred embodiment, with additional lateral force being placed on the paper towel roll cardboard core by the auxiliary spring members.

It is another object of the present invention to provide a spring actuated, paper towel holding and dispensing apparatus that successfully addresses the problem of the paper towel roll accidentally detaching from the present invention when the paper towel roll is being turned or when a paper towel is being torn off the paper towel roll.

It is another object of the present invention to provide a paper towel holding and dispensing apparatus that can be used with all brands of paper towels, regardless of minor variations in paper towel width.

It is another object of the present invention to provide a spring actuated, paper towel holding and dispensing apparatus that applies an even resistance to the rolling action of the paper towel roll. Thus, the present invention facilitates the release of precisely the number of sheets the user wishes, without excess paper towels coming off the paper towel roll or without excessive force being required to remove the paper towels from the paper towel roll. Thus, an advantage of the present invention is that it can be operated with one hand.

It is another object of the present invention to provide a spring actuated, paper towel holding and dispensing apparatus that applies pressure to the paper towel roll cardboard core without the paper towels rubbing against the support arms. This creates the advantage of controlled, sufficient pressure applied to the paper towel roll both when the paper towel roll is full and almost empty.

It is another object of the present invention to provide a device which does not require the use of a detachable spindle to hold the paper towel on the device. This creates several advantages. First, no spindle need be inserted into the paper towel core of the rolled paper towels, saving time and effort. Second, there is no spindle to lose, or springs inside the spindle to misplace.

It is another object of the present invention to provide a device that applies sufficient lateral force on the paper towel roll cardboard core without flexing the support arms outward from the paper towel roll and consequently, flexing and compromising the structural integrity of the main support over time.

It is another object of the present invention to provide a device that facilitates the quick and easy installation and removal of paper towel rolls.

It is another object of the present invention to provide a device that is simple in construction, inexpensive to manufacture, and ruggedly constructed.

Yet another object of the present invention is to provide a device that is made from a strong substance, such as plastic, and which parts can be attractively colored for consumer appeal.

It is another object of the present invention to provide a spring actuated, paper towel holding and dispensing apparatus that can be utilized in kitchens, laundry rooms, basements, garages, bathrooms, and any other place it is required.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | spring actuated, paper towel holding and dispensing apparatus |
| 20 | base support |
| 30 | attachment hole |
| 35 | attachment means |
| 40 | base support male projection |
| 50 | support arm receiving orifice |
| 60 | support arm |
| 70 | cylindrical shaft |
| 80 | spring member |
| 90 | spring member guide |
| 100 | spring member guide hole |
| 110 | spring member retaining orifice |
| 120 | spring member alignment protrusion |
| 130 | base support retention means |
| 140 | paper towel roll |
| 150 | flange |
| 160 | paper towel roll cardboard core |
| 170 | paper towel |
| 180 | tension adjustment assembly |
| 190 | retaining ring |
| 200 | cylindrical shaft threads |
| 210 | cylindrical shaft retaining ridge |
| 220 | cylindrical shaft receiving orifice |
| 230 | retaining tab |
| 240 | retaining notch |
| 250 | retaining tab ridge |
| 260 | tension adjustment means |
| 270 | groove |
| 280 | tension adjustment means thread |
| 290 | internal spring |
| 300 | internal spring housing |
| 310 | retention means hole |

DESCRIPTION OF THE PREFERRED EMBODIMENTS

In order to describe the complete relationship of the inventions, it is essential that some description be given to the manner and practice of functional utility and describe of a spring actuated, paper towel holding and dispersing apparatus 10.

The best mode for carrying out the invention is presented in terms of its preferred embodiment, herein depicted within the FIGS. 1 through 5.

1. Detailed Description of the Figures

Figure 1:
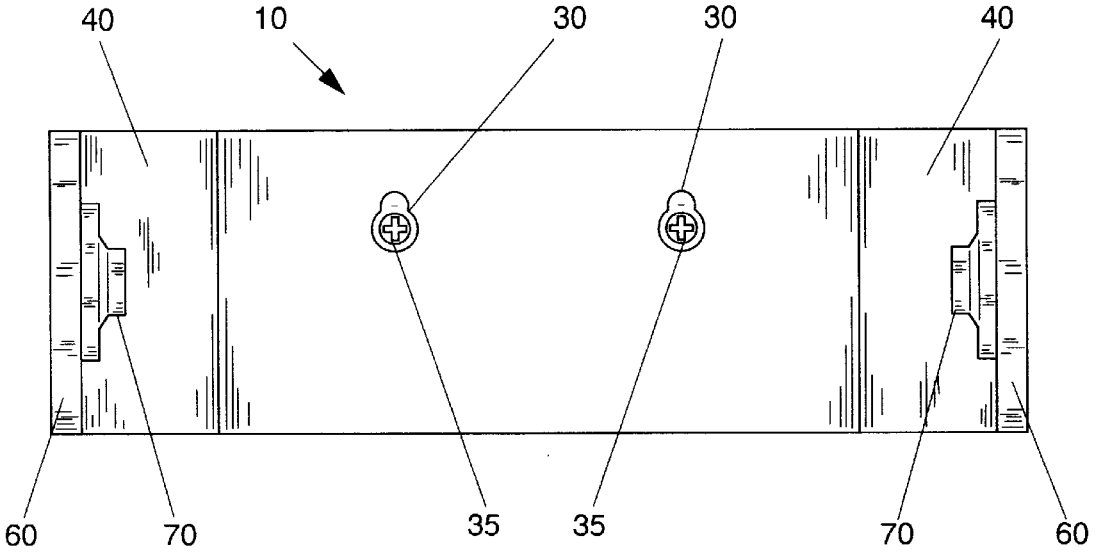
FIG. 1 is a front view of the preferred embodiment of a spring actuated, paper towel holding and dispensing apparatus.
Figure 2:
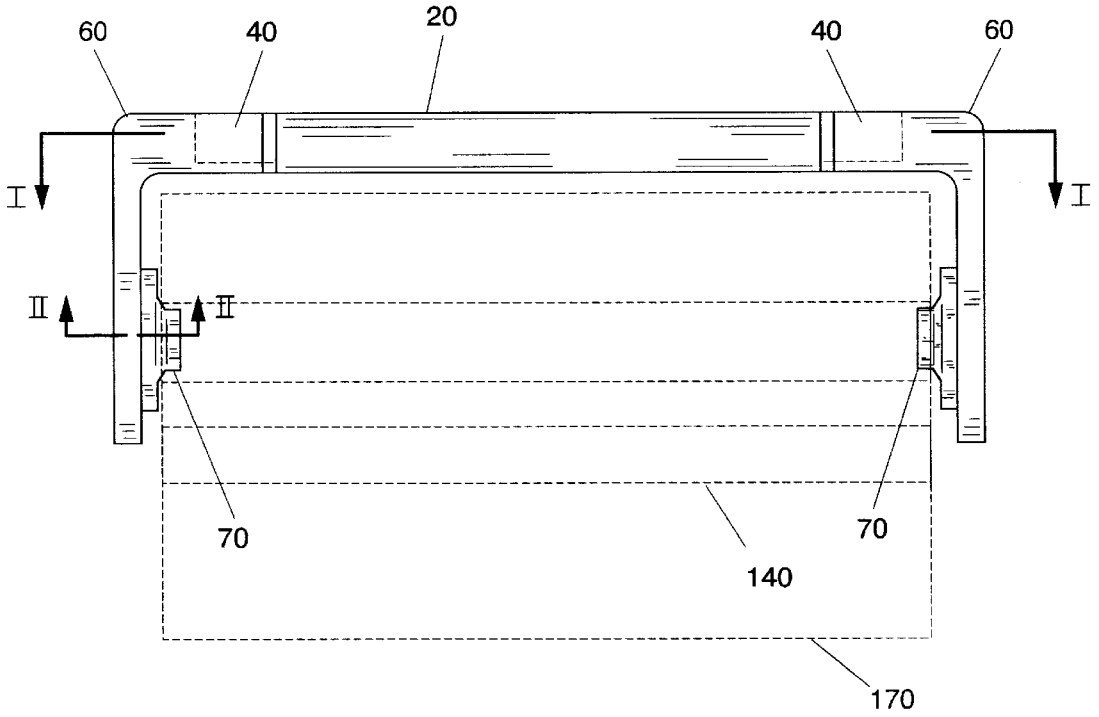
FIG. 2 is a top view of the preferred embodiment.
Figure 3:
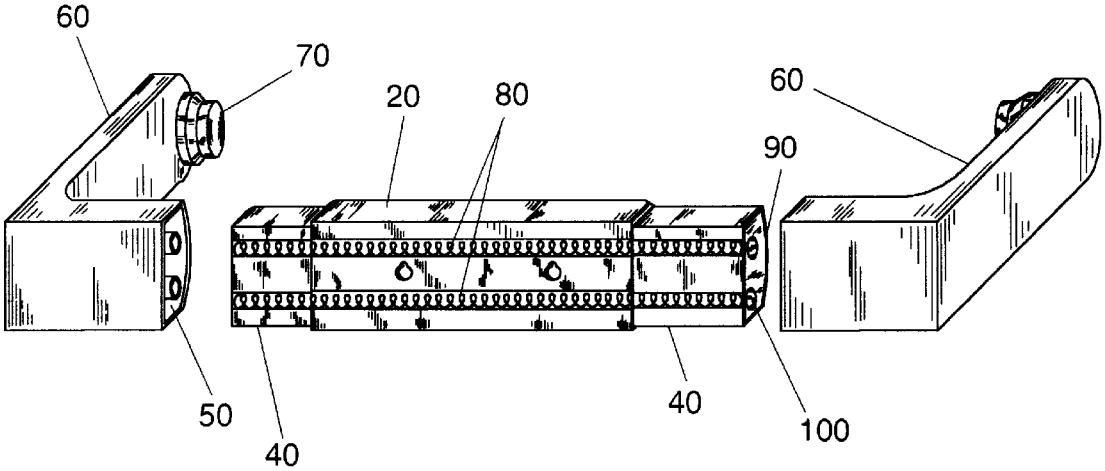
FIG. 3 is a rear perspective cross sectional view of the preferred embodiment cut along line I—I, showing a partial cutaway view of the base support.

Referring now to FIGS. 1, 2, and 3, a spring actuated, paper towel holding and dispensing apparatus 10 is shown, according to the present invention, and which consists of a base support 20. The base support 20 is longitudinally elongated, and is constructed of a durable, lightweight material, such as plastic. Positioned in lateral linear alignment on the base support 20 are two attachment holes 30, which can be used in conjunction with an attachment means 35, such as screws, to attach the present invention to a wall, underneath a cabinet, etc. The base support 20 extends outward and terminates on either end with a base support male projection 40. The base support male projections are tapered in design. Each of the two base support male projections pass into and terminate inside of a support arm receiving orifice 50. Attached to the end of each support arm receiving orifice 50 is a support arm 60. Each support arm 60 is elongated and extends outward, perpendicular to the centerline of the base support 20. Connected to the interior surface of each support arm 60, opposite the support arm receiving orifice 50, is a cylindrical shaft 70. Each cylindrical shaft 70 is mounted such that its center line is perpendicular to the interior planar surface of each support arm 60 and parallel to the centerline of the base support 20.

Referring to FIG. 3, two spring members 80 are positioned within the base support 20. The two spring members 80 extend laterally, running parallel to the center line of the base support 20, which is hollow in design. Each spring member 80 is positioned in the same plane relative to the centerline of the base support 20. Each spring member 80 passes through the center of the base support 20, being kept equidistant from each other by means of a spring member guide 90.

Figure 4:
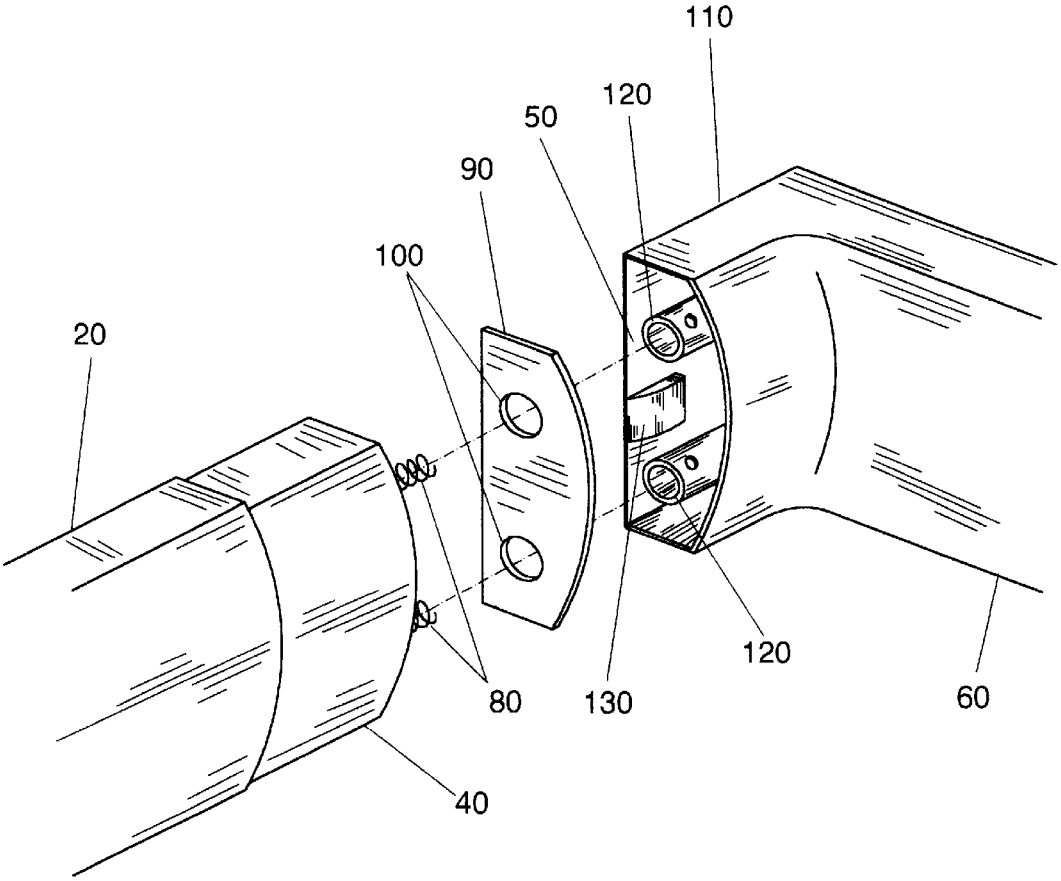
FIG. 4 is an enlarged, exploded, perspective view of the support arm and base support showing how they are connected.

Referring now to FIG. 4, the spring member guide 90 consists of two spring member guide holes 100 positioned in vertical linear alignment. The spring member guide 90 is positioned at the end of each base support male projection 40. Each spring member 80 passes through the hollow base support male projection 40 and through a spring member guide hole 100. Each spring member 80 attaches to the support arm 60 by means of a spring member retaining orifice 110, which is positioned on the exterior surface of a spring member alignment protrusion 120. The spring member alignment protrusions 120 are cylindrical in shape, and are positioned on the interior surface of the support arm receiving orifice 50, extending laterally outward, toward the base support 20. Each spring member alignment protrusion 120 is in linear alignment with the corresponding spring member 80.

When each base support male projection 40 is inserted into the corresponding support arm receiving orifice 50, each of the two spring member alignment protrusions 120 is inserted into the corresponding spring member guide hole 100. A base support retention means 130, such as a raised wedge, is positioned on the rear interior surface of the support arm receiving orifice 50. The base support retention means 130 is positioned such that it increases in thickness as its depth into the support arm receiving orifice 50 increases. Once the spring member guide 90 slides over the base support retention means 130, its lateral movement is limited such that the base support male projection 40 cannot exit from the support arm receiving orifice 50. Once the base support 20 and the support arm receiving orifice 50 are connected, the relative lateral position of each support arm 60 with respect to the base support 20 can be varied such that the lateral distance between the support arms 60 can be adjusted to fit a variety of paper towel rolls 140 of differing widths.

Figure 5:
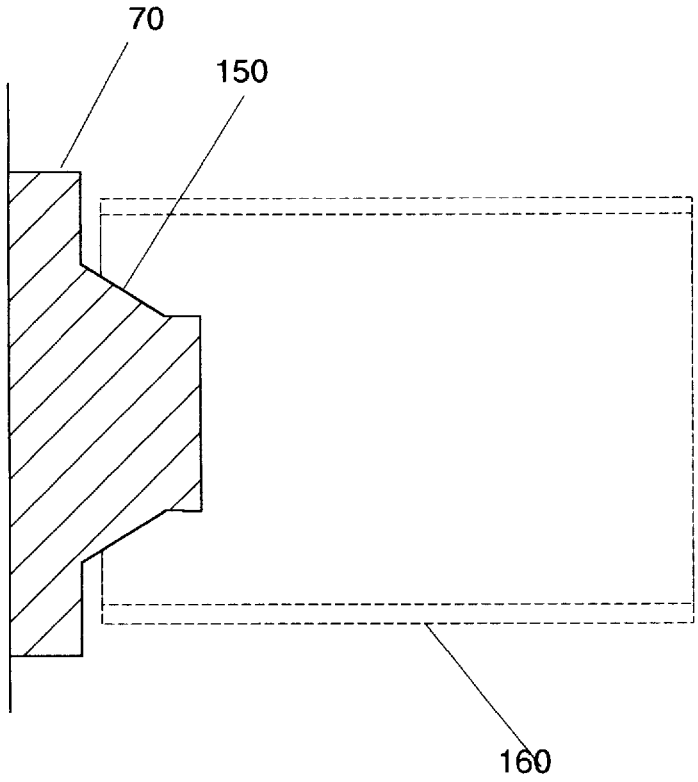
FIG. 5 is an enlarged, front, cross sectional view of the cylindrical shaft cut along line II—II.

FIG. 5 provides further detail as to the configuration of the cylindrical shaft 70. The cylindrical shaft 70 contains a flange 150 at the position where the paper towel roll cardboard core 160 contacts the cylindrical shaft 70. The flange 150 permits the cylindrical shaft 70 to come in contact primarily with the paper towel roll cardboard core 160, and not the paper towels 170 on the paper towel roll 140. This creates even tension regardless of the amount of paper towels 170 on the paper towel roll 140.

Figure 6:
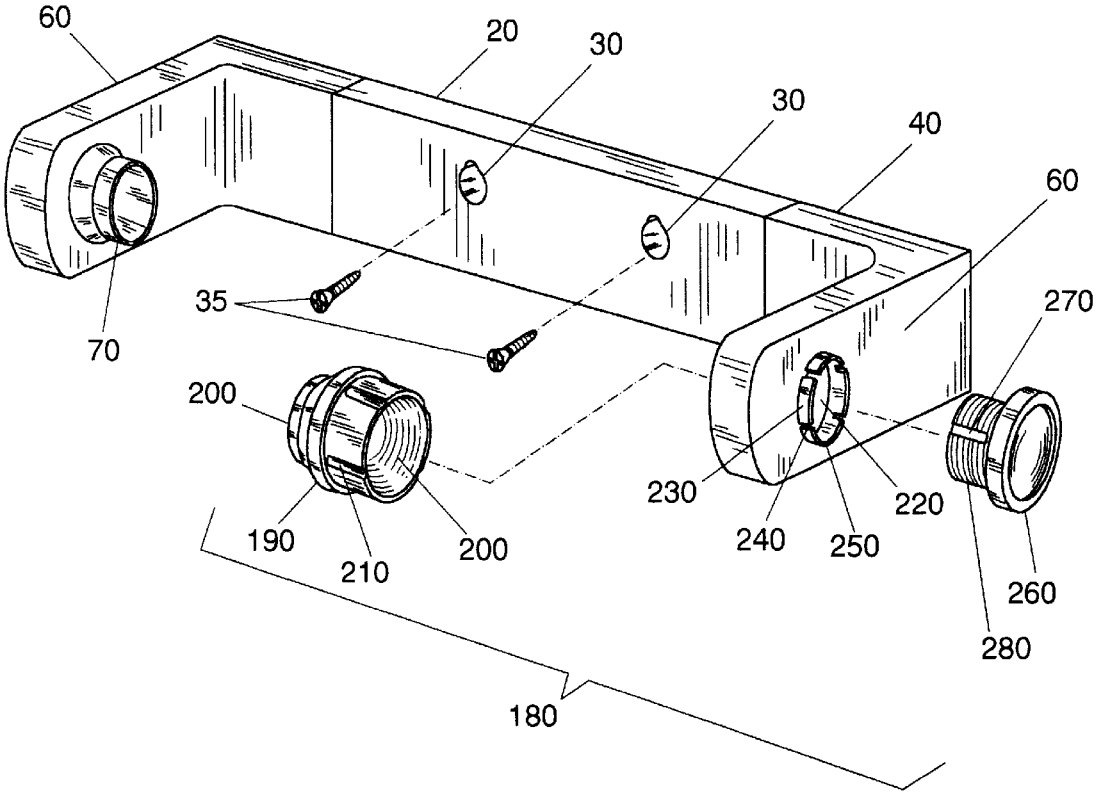
FIG. 6 is an exploded perspective view of the tension adjustment assembly of an alternate embodiment.

Referring now to FIG. 6, an alternate embodiment of the present invention is disclosed, in which a tension adjustment assembly 180 located on each support arm 60 is used to adjust the lateral force placed upon a paper towel roll 140. Each cylindrical shaft 70 is held in place by means of a retaining ring 190. The interior surface of each cylindrical shaft 70 is equipped with cylindrical shaft threads 200. Located on the exterior surface of each cylindrical shaft 70 is a series of three cylindrical shaft retaining ridges 210, which are equidistantly located relative to the radial center of each cylindrical shaft 70.

A cylindrical shaft receiving orifice 220 is positioned in the center of each support arm 60 on the side of the support arm 60 opposite the base support 20. The radial center of each cylindrical shaft receiving orifice 220 is parallel to the center line of the base support 20.

Positioned on the exterior surface of each support arm 60, along the outside edge of the cylindrical shaft receiving orifice 220, are a series of retaining tabs 230. Equally spaced between the retaining tabs 230 are three retaining notches 240. The cylindrical shaft 70 slides into the cylindrical shaft receiving orifice 220. The cylindrical shaft retaining ridges 210 fit in the corresponding retaining notch 240 on the support arm 60, thereby, limiting rotational movement of the cylindrical shaft 70.

Located on the ends of the retaining tabs 230 is a series of retaining tab ridges 250. The retaining tab ridges 250 connect to the tension adjustment means 260 by snapping into grooves 270 on the tension adjusting means 260. The tension adjusting means 260 is equipped with tension adjusting means threads 280, which mate with the cylindrical shaft threads 200. Turning the tension adjusting means 260 clockwise causes the cylindrical shaft 70 to telescope into the end of the paper towel roll cardboard core 160, thus creating the necessary tension to control the dispensing of paper towels 170 while simultaneously ensuring that the paper towel roll 140 will not detach from the cylindrical shaft 70.

Figure 7A:
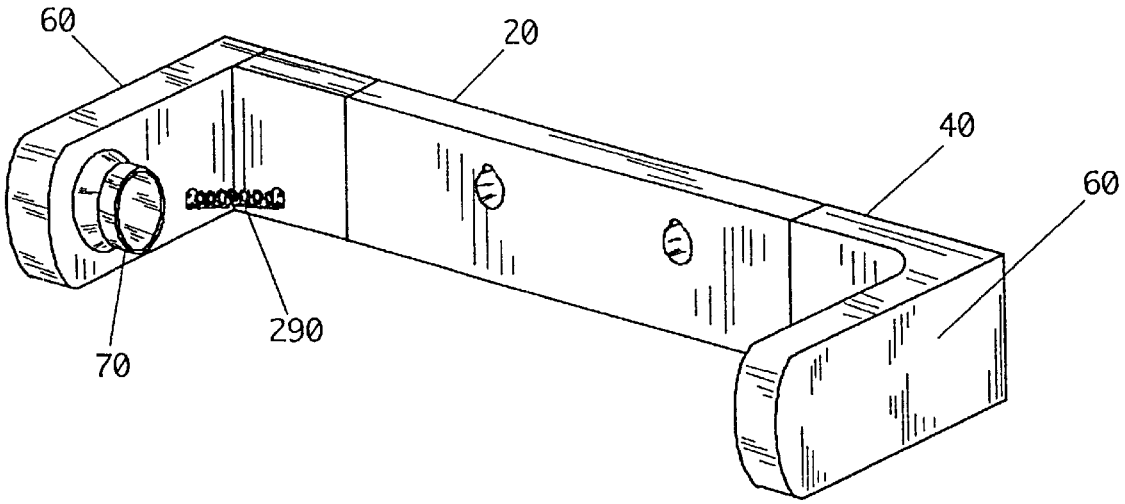
FIGS. 7*a* and 7*b* are a front perspective view of another alternate embodiment of the present invention.
Figure 7B:
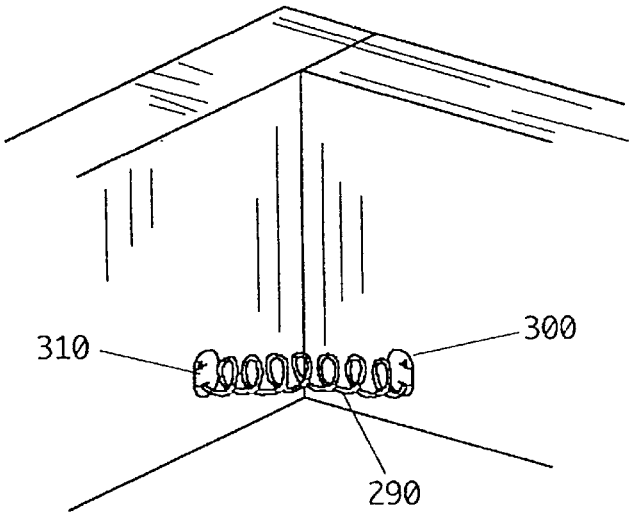

Referring now to FIGS. 7*a* and 7*b*, and alternate embodiment of the present invention is disclosed, showing a variation of the tension adjustment assembly 180. An internal spring 290 is positioned outside and adjacent of the cylindrical shaft 70. The internal spring 290 and cylindrical shaft 70 share the same axial center. The internal spring 290 provides the lateral force against the paper towel roll 40, instead of cylindrical shaft threads 200 and a tension adjusting means 260 of the previous alternate embodiment. An internal spring housing 300 is a cylindrical protrusion positioned on the outside surface of each support arm 60 and extending laterally downward. The end of the internal spring housing 300 opposite the support arm 60 terminates with an end surface consisting of a retraction means hole 310 with the same axial center as the internal spring housing 300.

The cylindrical shaft retaining ridges 210 that slide into retaining notches 240 on the internal spring housing 300 prevent rotational movement of the cylindrical shaft 70, very much like in the previous alternate embodiment.

2. Operation of the Preferred Embodiment

In accordance with a preferred embodiment of the present invention, to use the device, one separates the support arms 60 by pulling them apart. The paper towel roll 140 is then placed in between the support arms 60, and the paper towel roll cardboard core 160 is place over the cylindrical shafts 70. The separation of the two support arms 60 elongates the two spring members 80, which places sufficient, even, lateral force on the paper towel roll cardboard core 160 when the support arms 60 are released. The paper towel roll 140 will turn slowly and evenly, permitting the easy tearing of the desired number of paper towels 170, with one hand, without the paper towel roll 140 becoming disconnected from the cylindrical shafts 70.

In the alternate embodiment with the tension adjustment assemblies 180, the same process is repeated. However, once the support arms 60 have been released, then each tension adjusting means 260 is turned clockwise, thus forcing the cylindrical shaft 70 deeper into the paper towel roll cardboard core 160.

The foregoing description is included to illustrate the operation of the preferred embodiment and is not meant to limit the scope of the invention. The scope of the invention is to be limited only by the following claims.

What is claimed is:

1. A spring actuated, paper towel holding and dispensing apparatus for paper towel rolls having a cardboard core, consisting of;

a base support, said base support having lateral ends, a centerline, and a posterior surface, and said base support being longitudinally elongated, and constructed of a durable, lightweight material;

two attachment holes, said attachment holes being positioned in lateral linear alignment on the posterior surface of said base support, said attachment holes used in conjunction with an attachment means, such as screws, to attach the spring actuated, paper towel holding and dispensing apparatus to a wall;

two base support male projections; said base support male projections having an end, are hollow in design, and said base support male projections located at the ends of said base support;

two support arms, said support arms have an interior surface, an exterior surface and an end, and said support arms being of elongated shape and located perpendicular to the centerline of said base support, and used to hold the paper towel roll in place;

two support arm receiving orifices, said support arm receiving orifices having an interior surface, and said support arm receiving orifices being designed to allow said base support male projection to be slidably inserted therein;

two cylindrical shafts, each said cylindrical shaft having at least one end, an interior surface and an exterior surface, and said cylindrical shafts being used to hold the paper towel rolls and apply pressure to the paper towel roll;

two spring members, said spring members running inside said base support, laterally, and said spring members being used to provide the lateral tension to the paper towel roll;

two spring member guides, said spring member guides used to keep said spring members in alignment in the horizontal and vertical planes;

two spring member alignment protrusions, said spring member alignment protrusions having an exterior surface, and said spring member alignment protrusions used to keep said spring members in alignment, and used to secure said spring member to said support arm;

two spring member retaining orifices, said spring member retaining orifices located on said spring member alignment protrusions, and used to secure said spring members to said spring member alignment protrusions;

two base support retention means, said base support retention means being of wedged shape and used to limit movement of the base support male projection once inserted into said support arm receiving orifice;

two tension adjustment assemblies, said tension adjustment assemblies located on the end of each said support arm opposite said support arm receiving orifice, said tension adjustment assemblies used to provide variable resistance to the paper towel roll.

2. The paper towel holder described in claim 1, wherein each said base support male projection are positioned at the lateral ends of said base support, with said base support male projections being tapered in design and used as the connection point between said spring members and said support arms.

3. The paper towel holder described in claim 1, wherein each said support arms are elongated and extending outward, perpendicular to the centerline of said base support, and are laterally removable.

4. The paper towel holder described in claim 1, wherein each said support arm receiving orifices are connected to said support arms, perpendicular to said support arms, said support arm receiving orifices being the orifices into which said base support male projections pass and terminate inside of.

5. The paper towel holder described in claim 1, wherein each cylindrical shaft is connected to the interior surface of each said support arm at the end of said support arm, opposite said support arm receiving orifice, with each said cylindrical shaft being mounted such that a center line of each cylindrical shaft is perpendicular to the interior planar surface of each said support arm and parallel to the centerline of said base support, and each said cylindrical shaft contains a flange at the position where the paper towel roll cardboard core contacts said cylindrical shaft, such that said flange permits said cylindrical shaft to come in contact primarily with the paper towel roll cardboard core, and not the paper towels on the paper towel roll, thereby creating even tension regardless of the amount of paper towels on the paper towel roll.

6. The paper towel holder described in claim 1, wherein each said spring members are positioned within said base support with said spring members extending laterally, running parallel to the center line of said base support and each said spring member positioned in the same plane relative to the centerline of said base support and passing through the center of said base support.

7. The paper towel holder described in claim 1, wherein each said spring member guides are used to keep said spring members equidistant from each other, in the vertical plane, as said spring members pass through said base support, and said spring member guide consisting of two spring member guide holes positioned in vertical linear alignment, and said spring member guides positioned at the end of each said base support male projection, such that each said spring member passes through each of said base support male projection and through said spring member guide hole.

8. The paper towel holder described in claim 1, wherein each said spring member alignment protrusions are cylindrical in shape, and positioned on the interior surface of said support arm receiving orifice, extending laterally outward, toward said base support, with each said spring member alignment protrusion in linear alignment with the corresponding said spring member, such that when each said base support male projection is inserted into the corresponding said support arm receiving orifice, each of the two said spring member alignment protrusions is inserted into the corresponding said spring member guide hole.

9. The paper towel holder described in claim 1, wherein said spring member retaining orifices are positioned on the exterior surface of each of said spring member alignment protrusions, and is the means by which each said spring member attaches to the corresponding said spring member alignment protrusion, which is connected to said support arm.

10. The paper towel holder described in claim 1, wherein each said base support retention means being of a raised wedge, positioned on the rear interior surface of each of said support arm receiving orifice, each of said base support retention means positioned such that each base support retention means increases in thickness as its depth into said support arm receiving orifice increases, such that once said spring member guide slides over said base support retention means, each of said spring member guide's lateral movement is limited such that said base support male projection cannot exit from said support arm receiving orifice.

11. The paper towel holder described in claim 1, wherein once said base support and said support arm receiving orifices are connected, the relative lateral position of each said support arm with respect to said base support can be varied such that the lateral distance between said support arms can be adjusted to fit a variety of paper towel rolls of differing widths.

12. The paper towel holder described in claim 1, wherein each said tension adjustment assemblies are located on each said support arm and is used to adjust the lateral force placed upon a paper towel roll, each of said tension adjustment assemblies further comprising;

a retaining ring, said retaining ring used to hold each said cylindrical shaft in place;

cylindrical shaft threads, said cylindrical shaft threads located on the interior surface of each cylindrical shaft;

three cylindrical shaft retaining ridges, said cylindrical shaft retaining ridges being located on the exterior surface of each cylindrical shaft, and equidistantly located relative to the radial center of each said cylindrical shaft;

a cylindrical shaft receiving orifice, said cylindrical shaft receiving orifice having an outside edge, and said cylindrical shaft receiving orifice being positioned in the center of each said support arm on the side of said support arm opposite said base support, with the radial center of each said cylindrical shaft receiving orifice being parallel to the center line of said base support, said cylindrical shaft sliding into said cylindrical shaft receiving orifice;

retaining tabs, said retaining tabs having at least one end, and said retaining tabs being positioned on the exterior surface of each support arm, along the outside edge of the cylindrical shaft receiving orifice;

three retaining notches, said retaining notches being equally spaced between said retaining tabs, such that said cylindrical shaft retaining ridges fit in the corresponding said retaining notch on said support arm, thereby, limiting rotational movement of said cylindrical shaft;

retaining tab ridges, said retaining tab ridges being located on the ends of the retaining tabs;

a tension adjustment mean, said tension adjustment means being of cylindrical configuration, and used to provide tension to the paper towel roll.

13. The paper towel holder described in claim 12, wherein said tension adjustment means is further comprised of;

grooves, said grooves located on the exterior surface of said tention adjustment means, said grooves being used to secure said tension adjustment means to said support arm by said retaining tab ridges connecting to said tension adjustment means by snapping into said grooves;

tension adjusting means threads, said tension adjusting means threads mating with said cylindrical shaft threads, such that turning said tension adjusting means clockwise causes said cylindrical shaft to telescope into the end of the paper towel roll cardboard core, thus creating the necessary tension to control the dispensing of paper towels while simultaneously ensuring that the paper towel roll will not detach from the cylindrical shaft.

* * * * *